United States Patent [19]

Thompson et al.

[11] 4,138,969

[45] Feb. 13, 1979

[54] HEAT EXCHANGER AND ECONOMIZER

[75] Inventors: Garris A. Thompson, Orangeburg, S.C.; John H. Merritt, Jr., Atlanta, Ga.

[73] Assignee: Applied Engineering Co., Orangeburg, S.C.

[21] Appl. No.: 813,805

[22] Filed: Jul. 8, 1977

[51] Int. Cl.[2] ..... F22D 1/08

[52] U.S. Cl. ..... 122/421; 165/78

[58] Field of Search ..... 165/78; 122/412, 421

[56] References Cited

U.S. PATENT DOCUMENTS

| | | | |
|---|---|---|---|
| 1,612,854 | 1/1927 | Broido | 122/412 |
| 1,786,909 | 12/1930 | Jackson et al. | 165/78 |
| 2,615,687 | 10/1952 | Simmons | 165/78 |
| 3,313,274 | 4/1967 | Hendrix | 165/78 |
| 3,910,236 | 10/1975 | Merritt, Jr. | 122/421 |

*Primary Examiner*—Kenneth W. Sprague

*Attorney, Agent, or Firm*—B. J. Powell

[57] ABSTRACT

A heat exchanger with a housing defining a main fluid flow passage therethrough and a tube bundle access opening to the fluid flow passage, a tube bundle unit removably positioned in the housing in the fluid flow passage through the access opening, and a cover for removably closing the access opening so that heat exchange fluid flowing through the tube bundle unit is in a heat exchange relation with the fluid flowing through the housing main fluid flow passage around the tube bundle unit. Also shown is an economizer for a stream boiler incorporating a heat exchanger.

7 Claims, 5 Drawing Figures

HEAT EXCHANGER AND ECONOMIZER

BACKGROUND OF THE INVENTION

Many types of heat exchangers are commercially available on the market today. One of the primary problems with such heat exchangers, however, is that the tube bundle is normally fixed in the main housing of the heat exchanger so that it cannot be removed to easily repair any of the tubes in the tube bundle that may deteriorate. This means that, in order to repair one of these prior art heat exchangers, it is necessary to either remove the entire heat exchanger including the housing from its installation so as to gain access to the tube bundle in the heat exchanger to repair same or for a workman to enter the main housing and repair the defective tube while the heat exchanger is in place. This results in considerable down time of the equipment on which the heat exchanger is being used and further makes the repair of the particular tube that is deteriorated in the tube bundle extremely difficult since it cannot be removed from the housing to gain access thereto. If another heat exchanger is actually inserted into the installation while the deteriorated heat exchanger is being repaired, the cost of maintaining these spare complete heat exchangers is prohibitive from a maintenance standpoint.

One common application for heat exchangers is an economizer which preheats feedwater supplied to a steam boiler. One of the problems encountered with the use of such economizers is that corrosive condensates are formed if the average temperature of the flue gases from the boiler drops below the dew point of the particular flue gases produced by the boiler. These prior art economizers have solved the condensation problem by maintaining all surfaces in the economizer with which the flue gases come into contact above the condensation temperature of the flue gases. While this prior art technique has prevented condensation, it has at the same time limited the rate at which heat can be transferred from the flue gases to the feedwater passing through the heat exchanger in the economizer. This is because this technique lowers the difference between the temperature of the flue gases and the temperature of the feedwater in the economizer which in turn controls the rate of heat transfer from the flue gases to the feedwater in the economizer. The net result has been that these prior art economizers required large heat exchangers therein in order to maximize the heat recovered from the flue gases by the feedwater passing through the economizer.

SUMMARY OF THE INVENTION

These and other problems and disadvantages associted with the prior art are overcome by the invention disclosed herein by the provision of a heat exchanger in which the tube bundle in the heat exchanger is selectively removable from the housing while the housing remains in place to permit easy access to the tube bundle for repair thereof. Further, this permits the housing to be used without the heat exchanger therein while the tube bundle is removed for repair to minimize the down time of the equipment to which it is attached. Additionally, a spare tube bundle may be economically placed in the housing while the defective tube bundle is being repaired.

The invention disclosed herein further overcomes the problems associated with the prior art economizers by selectively recirculating a portion of the feedwater passing through the heat exchanger in the economizer in response to the average temperature of the flue gases after passage through the heat exchanger to maintain the average temperature of the flue gases on the exit side of the economizer above the dew point thereof. Alternatively, the flow of the feed water may pass through the heat exchanger in the economizer or bypass the heat exchanger in the economizer in response to the average temperature of the flue gases as they exit the economizer.

The apparatus of the invention includes a heat exchanger which has a housing defining a primary fluid passage therethrough with a fluid inlet and fluid outlet on opposite sides of the housing. The housing further defines a pair of tube end subchambers on opposite sides thereof which open into the main fluid passage and which are oriented about a common axis normal to the central axis of the first fluid passage through a housing. The housing further defines a tube bundle access opening to the main fluid passage and the tube end subchambers which is selectively covered by a cover member. A tube bundle is slidably received into the main fluid passage and the tube end subchambers through the tube bundle access opening so that the tube bundle can be removed from the housing with the housing in place in the installation. The tube sheets which mount the tubes in the tube bundle serve to seal the tube end subchambers from the main fluid passage in the heat exchanger from bypassing the tube bundle. Thus, when a second fluid is passed through the tube bundle, the tube bundle places a second fluid in a heat exchange relationship with the first fluid passing through the main fluid passage.

The apparatus of the invention as embodied in an economizer for a steam boiler includes the heat exchanger positioned in the flue gas duct from a steam boiler with a feedwater source connected to the feedwater inlet of the steam boiler through the tube bundle in the heat exchanger. A three way valve is positioned in this connection to selectively divert the flow of feedwater back through the tube bundle by a circulating pump in response to the average temperature of the flue gases after passage through the heat exchanger. Alternatively the three way valve may divert the feedwater for flow through the tube bundle in the heat exchanger to the feedwater inlet of the steam boiler or bypass the tube bundle in the heat exchanger in response to the average temperature of the flue gases as they pass from the heat exchanger.

These and other features and advantages of the invention will become more clearly understood upon consideration of the following specification and accompanying drawings wherein like characters of reference designate corresponding parts throughout the several views and in which:

These figures and the following detailed description disclose specific embodiments of the invention, however, it is to be understood that the invention may be embodied in other forms.

DETAILED DESCRIPTION OF ILLUSTRATIVE EMBODIMENTS

Referring to the figures, it will be seen that the heat exchanger 10 includes a housing 11 and a tube bundle unit 12 removably mounted in the housing 11. The heat exchanger 10 may be used in a number of different applications but is illustrated in FIGS. 2 and 3 being used in an economizer configuration with FIG. 3 illustrating its use on a steam boiler.

Figure 1:
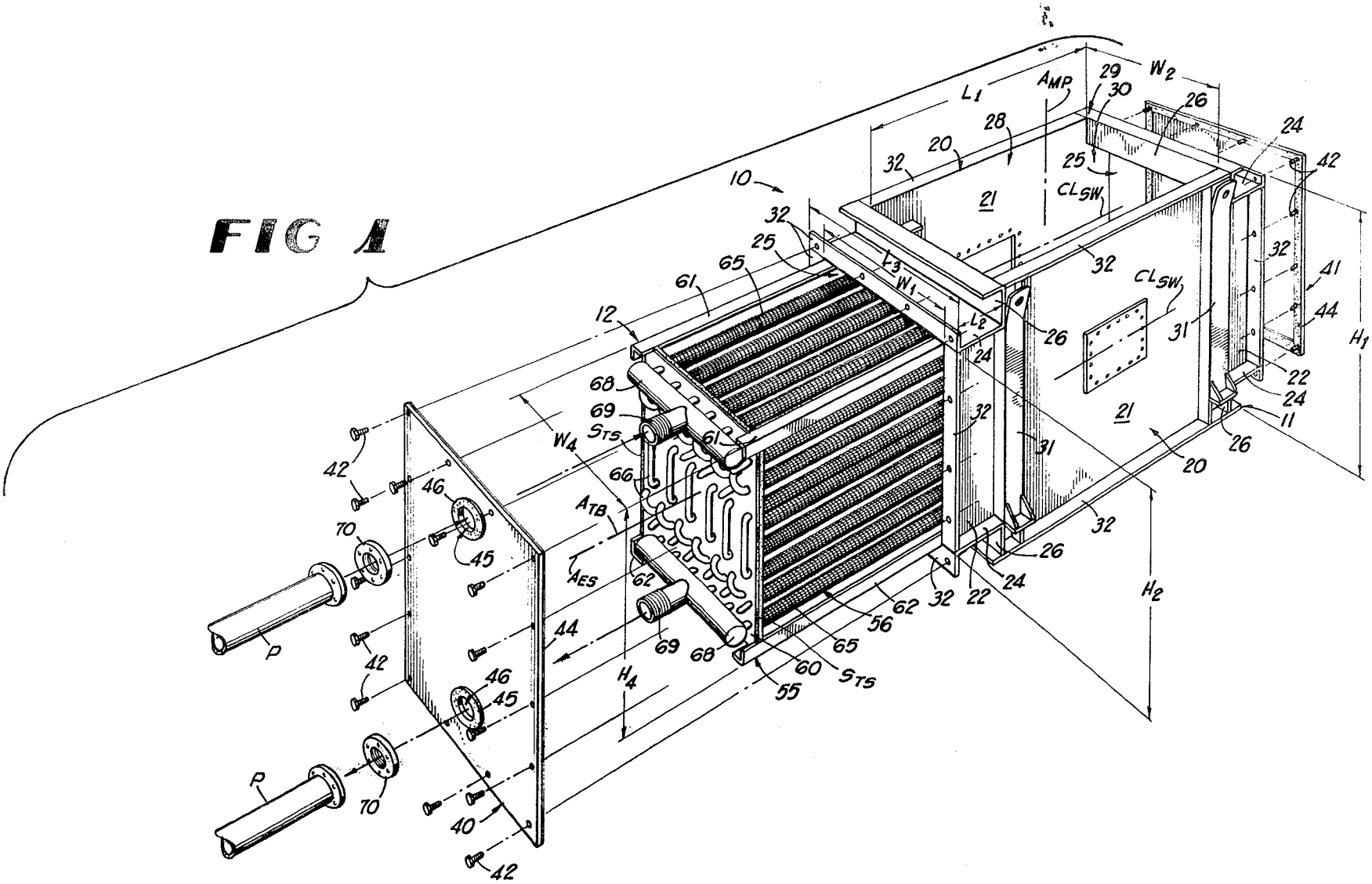
FIG. 1 is an exploded perspective view showing the heat exchanger of the invention.
Figure 2:
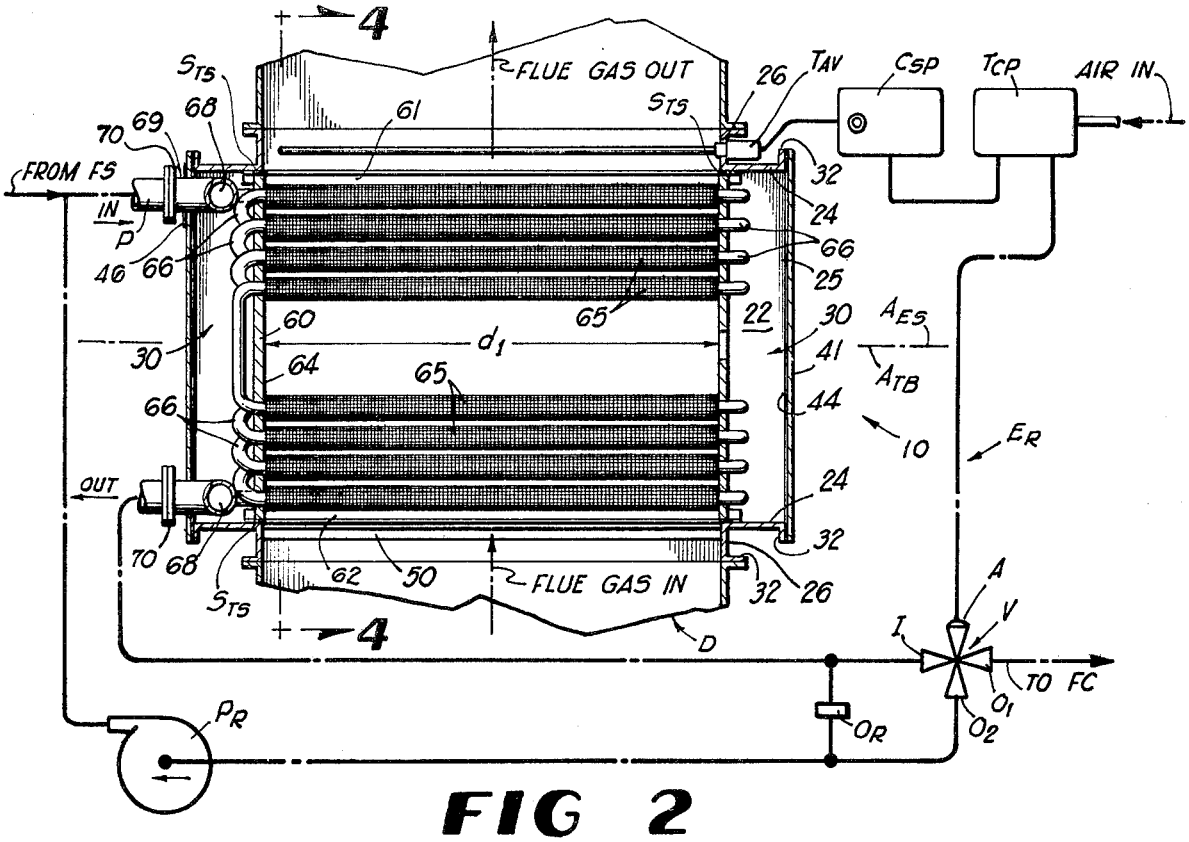
FIG. 2 is a reduced longitudinal cross-sectional view of the heat exchanger of FIG. 1 incorporated in an economizer.
Figure 3:
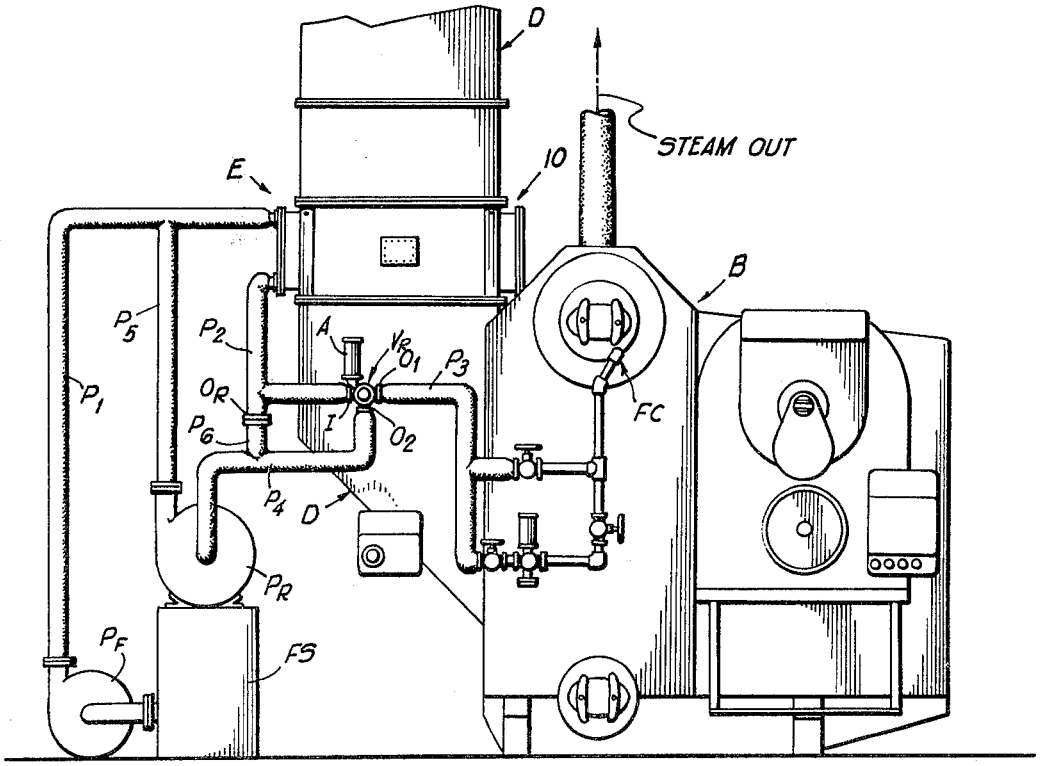
FIG. 3 is a reduced elevational view showing the heat exchanger being used as an economizer on a steam boiler.

The housing 11 as seen in FIGS. 1 and 2 includes a pair of generally parallel spaced apart side walls 20, each of which has a longitudinal centerline $CL_{SW}$. Each of the side walls 20 has a main central section 21 which is centered on the centerline $CL_{SW}$ with a length $L_1$ and a height $H_1$. Each corner of each side wall 20 is notched to form an end tube subchamber extension 22 with a length $L_2$ and a height $H_2$. The height $H_2$ of each end tube subchamber extension 22 is less than the height $H_1$ of the main central section 21 as best seen in FIG. 1 and the extension 22 is centered with respect to the centerline $CL_{SW}$. Therefore, it will be seen that each end tube subchamber extension 22 on each side wall 20 will be laterally aligned with a corresponding subchamber extension 22 on the opposite side wall 20. The upper and lower ends of each end tube subchamber extension 22 is connected to the laterally aligned subchamber extension 22 by an end tube subchamber cross plate 24. Thus, the end tube subchamber cross plates 24 determine the overall depth of the housing 11. Each cross plate 24 has a length $L_3$ as best seen in FIG. 1 so that opposite ends of the cross plate 24 project beyond the end tube subchamber extension 22 in side walls 20. Each pair of laterally aligned extensions 22 in side walls 20 and the cross plates 24 connecting the extensions 22 define a tube bundle access opening 25 therethrough with the height $H_2$ and a width $W_1$ as best seen in FIG. 1 which opens into the end tube subchamber 30 bounded by extensions 22 and cross plates 24. The opposed end tube subchambers 30 and their access openings 25 are centered on a common axis $A_{ES}$ normal to axis $P_{MP}$ and parallel to side wall centerline $CL_{SW}$. The inboard end of each end tube subchamber 30 opens into the main fluid passage 28 as seen in FIGS. 1 and 2.

The laterally aligned edges of the main central sections 21 in side walls 20 at the notches are connected by fluid passage cross plates 26, each of which extends from the end tube subchamber cross plate 24 out to the top or bottom of the main central section 21 in the side walls 20. Thus, it will be seen that the main central section 21 of the side walls 20 along with the fluid passage cross plates 26 define the main fluid flow passage 28 therethrough about the central axis $A_{MP}$ which is oriented generally normal to the centerline $CL_{SW}$ of the side walls 20 and generally parallel to the plane of the side walls 20. The fluid passage cross plates 26 and the side walls 20 define main fluid openings 29 at the top and bottom side of the main central sections 21 of the side walls 20 so that the primary fluid can flow through the passage 28 in the housing 11 from one of the fluid openings 29, here shown as the bottom opening, to the opposite opening, here shown as the top opening 29 as best seen in FIG. 2. The direction of fluid flow through the heat exchanger 10 is immaterial. It will thus be seen that the fluid openings 29 and the main fluid flow passage 28 have the same cross-sectional shape with the length $L_1$ and width $W_2$ as best seen in FIG. 1. The particular size of the main fluid flow passage 28 is set by the duct work which connects the main fluid flow to the heat exchanger while the size of the tube bundle access openings 25 and the end tube subchambers 30 is set by the size of the tube bundle unit 12 as will become more apparent. While any fluid may be flowed through the main fluid flow passage 28, it is illustrated as placing flue gases in a heat exchange relationship with the fluid in the tube bundle unit 12 as will become more apparent.

Opposite ends of the main central section 21 in each of the side walls 20 is reinforced by an upstanding post 31 with reinforcing flanges 32 about all of the edges of the side walls 20, the subchamber cross plates 24 and the main fluid passage cross plates 26 to strengthen the housing 11. Those reinforcing flanges 32 about the main fluid openings 29 and the tube bundle access openings 25 serve as mounting flanges as will become more apparent.

The tube bundle access openings 25 are respectively removably closed by a front cover panel 40 and a rear cover panel 41 as seen in FIGS. 1 and 2. Each of the cover panels 40 and 41 is attached to the reinforcing flanges 32 about the tube bundle access openings 25 using appropriate fasteners 42 as seen in FIGS. 1 and 2. An appropriate gasket 44 is provided between each cover panel 40 and 41 and the reinforcing flanges 32 to which they are attached. The front cover panel 40 is provided with a pair of spaced apart header openings 45 seen in FIGS. 1 and 2 which permit the fluid passing through the tube bundle unit 12 to be introduced to and removed therefrom as will become more apparent. Each of the openings 45 is provided with an appropriate seal 46 to seal these openings as will become more apparent.

Figure 4:
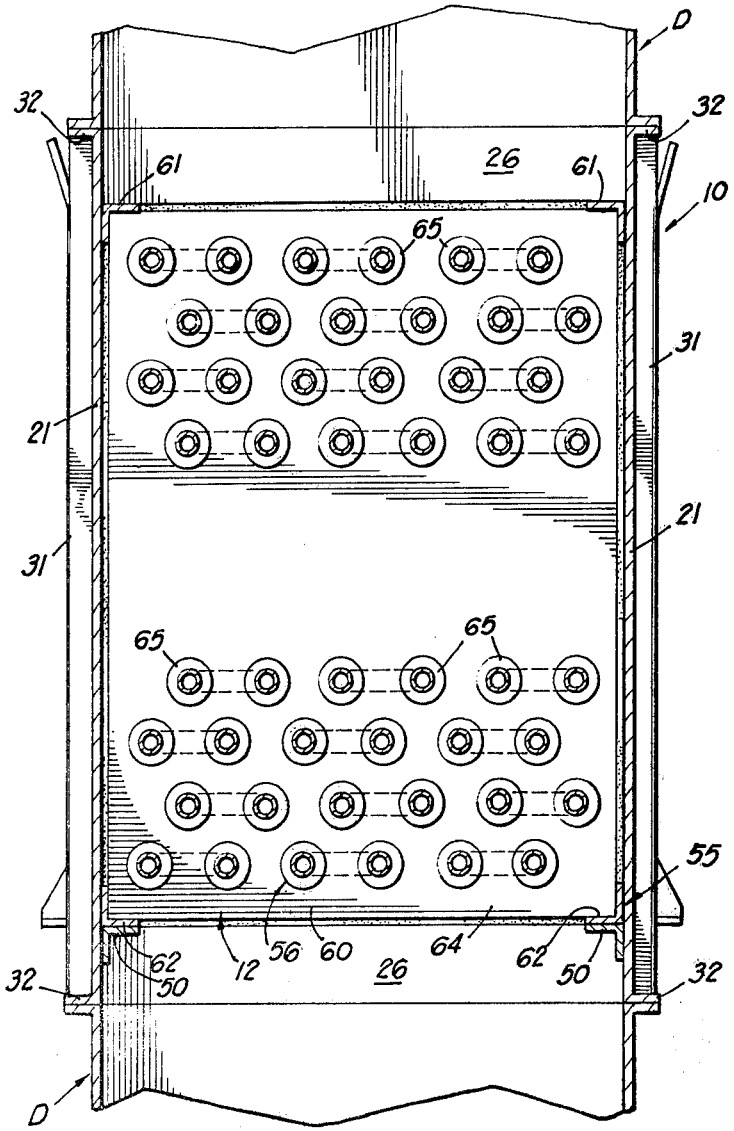
FIG. 4 is an enlarged transverse cross-sectional view taken along line 4—4 in FIG. 2; and, FIG. 5 is a view similar to FIG. 2 showing the heat exchanger of FIG. 1 incorporated in a different economizer.

As best seen in FIGS. 2 and 4, a tube bundle slide angle 50 is mounted on the lower inside of each central section 21 of the side walls 20 in alignment with the opposed cross plates 24. These slide angles 50 serve to support the tube bundle unit 12 as it slides into or out of the housing 11 as will become more apparent.

The tube bundle unit 12 as best seen in FIGS. 1, 2 and 4 includes a tube frame 55 which mounts the tube bundle 56 thereon about a longitudinal axis $A_{TB}$. The tube frame 55 includes a pair of spaced apart tube sheets 60 with a generally rectilinear shape. The tube sheets 60 are held in position by a pair of upper side members 61 and a pair of lower side members 62 which extend between the corners of sheets 60. The side members 61 and 62 are oriented generally parallel to each other and define the side corners of the frame 55. The frame 55 has a width $W_4$ and height $H_4$ such that the frame 55 will just slidably pass through the access openings 25 in housing 11 as seen in FIG. 1. The tube sheets 60 are spaced apart so that the opposed inside surfaces 64 thereof are spaced apart a distance $d_1$ substantially equal to the length $L_1$ of the main fluid passage 28 in housing 11 as seen in FIG. 2. Thus, when the frame 55 is in position in housing 11, the inside surfaces 64 of the tube sheets 60 are in registration with the main fluid cross plates 26 so that the main fluid passage 28 is about the same size all the way through the exchanger 10 when the frame 55 is in place. The ends of the side members 61 and 62 extend outboard of each of the tube sheets 60 into the tube end subchambers 30 when frame 55 is in place as seen in FIG. 2. The lower side members 62 are supported by the lower end tube subchamber cross plates 24 and the slide angles 50 extending between cross plates 24. Appropriate seals $S_{TS}$ may be provided along the edges of the tube sheets 60 between side members 61 and 62 to form a seal with cross plates 24 and side wall extensions 22 and thus separate the end tube subchambers 30 from the main gas passage 28.

The tube bundle 56 is mounted on the tube sheets 60 so that the straight exchange tubes 65 extend between the tube sheets 60 while the tube ends 66 connecting tubes 65 are outboard of tube sheets 60. Thus, when the tube bundle unit 12 is in position as seen in FIG. 2, the heat exchange tubes 65 extend across the main fluid passage 28 while the tube ends 66 are located in the tube end subchambers 30. The main fluid flowing through passage 28 will be placed in a heat exchange relationship with the exchanger fluid flowing through the heat exchanger tubes 65. The first and last row of tubes 65 are connected to headers 68 so that the heat exchange fluid can be introduced into and removed from the tube bundle 56. Each of the headers 68 has an inlet pipe 69 thereto which extends through the header openings 45 so that the tube bundle 56 can be externally connected when the tube bundle unit 12 and the front cover panel 40 are in place as seen in FIG. 2. The seals 46 seal the openings 45 to pipes 69. Usually, the pipes 69 are provided with screw-on flanges 70 to connect the pipes 69 to external piping P. The screw-on flanges 70 are, of course, removed to permit the front cover panel to be removed when the tube bundle unit 12 is to be removed.

It will be seen that the tube bundle unit 12 may be installed along its longitudinal axis as shown or, with appropriate relocation of cover panels 40 and 41, installed along its lateral axis normal to the main fluid flow. Also, it is necessary that only one cover panel need be provided rather than the two panels 40 and 41 as illustrated. Further, one of the cover panels 40 and 41 may be fixed to the tube bundle unit 12 so that when the tube bundle unit 12 is in place, the cover panel on the trailing end of the unit 12 will appropriately seal the access opening 25 through which the tube bundle unit 12 is installed.

OPERATION

In operation, it will be seen that the housing 11 is installed in conventional manner in the duckwork D as best seen in FIGS. 2-4. The housing 11, of course, is installed without the tube bundle unit 12 in place in the housing 11 and without the front and rear cover panels 40 and 41 in place. This makes the housing 11 relatively lightweight thereby reducing to a minimum the personnel and equipment necessary to install the housing 11.

After the housing 11 is installed, the tube bundle unit 12 is then installed. The tube bundle unit 12 is placed in the housing 11 by picking same up with appropriate equipment usually available at the installation site and placing one end of the tube bundle unit in one of the access openings 25 so that the lower side members 62 rest on the lower cross plate 24 at that access opening. The tube bundle unit 12 is positioned so that its axis $A_{TB}$ is coaxial with the axis $A_{ES}$ of the subchambers 30 and then the tube bundle unit 12 is pushed into the housing 11 with the lower side members 62 being supported on the end tube subchamber cross plates 24 and the tube bundle slide angles therebetween. When the tube bundle unit 12 is pushed into the housing so that the inside surfaces 64 of the tube sheets 60 align with the main fluid passage 28 through the housing 11, the tube bundle unit 12 is in place. The seals $S_{TS}$ on the tube sheets 60 seal the end tube subchambers 30 from the main fluid passage 28. If the screw-on flanges 70 on the inlet pipes 69 to headers 68 are in place, they are removed and the front and rear cover panels 40 and 41 are attached using the fasteners 42. If accessory equipment such as a soot blower is to be mounted, it is usually mounted through an appropriate hole in one of the tube sheets 60 before the cover panels 40 and 41 are attached. After the cover panels 40 and 41 are attached, the screw-on flanges 70 are re-attached so that the piping P can be connected to the inlet pipes 69 on headers 68. The heat exchanger 10 is now ready for operation. To remove or replace the tube bundle unit 12, it will be seen that this process is simply reversed.

If the repair of the tube bundle unit 12 will result in considerable down time of the equipment with which the heat exchanger 10 is being used, then the removed cover panels 40 and/or 41 may be replaced without the tube bundle unit 12 in housing 11. This will allow the operation of the equipment to continue even though the tube bundle unit 12 is not operational. When the tube bundle unit 12 is repaired, it can then be replaced and its operation continued.

ECONOMIZER INSTALLATION

The heat exchanger 10 is shown incorporated in a recirculating economizer $E_R$ in FIGS. 2 and 3. As shown in FIG. 3, the economizer $E_R$ is shown mounted on a conventional steam boiler B with the flue gas ductwork D and a feedwater inlet connection FC so that feedwater can be supplied to the steam boiler from a feedwater source FS as is normally required in steam boiler operation. The feedwater from the feedwater source FS is supplied to the boiler B under pressure by feedwater pump $P_F$ seen in FIG. 3. The heat exchanger 10 is connected to the feed water pump $P_F$ through the piping P and also to the feedwater connection FC on the boiler B. The heat exchanger 10 is plumbed in FIGS. 2 and 3 in a counterflow configuration so that the cooler feedwater from the pump $P_F$ enters the tube unit 12 on the downstream side of the main fluid passage 28 through the heat exchanger 10. This makes the upper header 68 in FIG. 2 the inlet header and the lower header 68 the outlet header as labelled in FIGS. 2 and 3.

Pipe $P_1$ as seen in FIG. 3 connects the feedwater water pump $P_F$ directly to the inlet header 68 in the heat exchanger 10 while pipe $P_2$ connects the outlet header 68 to the inlet I of a three-way flow diversion valve $V_R$. One outlet $O_1$ of the diversion valve $V_R$ is connected by pipe $P_3$ to the feedwater connection FC on boiler B. The other outlet $O_2$ of the flow diversion valve $V_R$ is connected to the inlet side of a recirculating pump $P_R$ by pipe $P_4$ as seen in FIG. 3 while the outlet side of the recirculating pump $P_R$ is connected back to the inlet header of the heat exchanger 10 through pipe $P_5$. If it is desirable to continuously operate the pump $P_R$, a short pipe $P_6$ with an orifice $O_R$ interposed therein may be used to connect the outlet header 68 of the heat exchanger 10 directly to the inlet side of the recirculating pump $P_R$ bypassing valve $V_R$ with a very small flow of heat exchanger fluid just sufficient to keep pump $P_R$ cool.

The flow diversion valve $V_R$ has an actuator A which selectively divides the flow of the feedwater through the valve $V_R$ from the inlet I so that the amount of feedwater flowing out the outlet $O_1$ and the amount of feedwater flowing out the outlet $O_2$ is selectively controlled. While any number of flow dividing valve constructions may be used, the valve $V_R$ illustrated in a pneumatically operated proportioning valve which proportions the flow between the outlets $O_1$ and $O_2$. To supply the pneumatic control pressure to operate the actuator A on valve $V_R$, an electrical-to-pneumatic transducer $T_{CP}$ may be used which produces an output pressure to the actuator A as seen in FIG. 2 in response to the electrical signal received by the transducer $T_{CP}$. The control for the transducer $T_{CP}$ is provided by an averaging thermocouple $T_{AV}$ seen in FIG. 2 which is inserted into the ductwork D on the downstream side of the main fluid passage 28 through the heat exchanger 10. The thermocouple $T_{AV}$ provides an electrical output signal that is controlled by the average temperature of the flue gases passing out of the heat exchanger 10 and is connected to an appropriate thermocouple set point controller $C_{SP}$ designed to operate with the averaging thermocouple $T_{AV}$. The controller $C_{SP}$ produces an electrical output which is indicative of the average flue gas temperature above or below a particular set range manually set on controller $C_{SP}$ as it passes out of the heat exchanger 10. The transducer $T_{CP}$ receives this electrical signal from the controller $C_{SP}$ and converts this signal into a pneumatic output to the actuator A on valve $V_R$ which is responsive of the average flue gas temperature passing out of the heat exchanger 10.

If the temperature of the flue gases passing out of the heat exchanger 10 drops below the predetermined value manually set on controller $C_{SP}$, the transducer $T_{CP}$ operates the valve $V_R$ so that a certain portion of the feedwater flowing in the inlet I of valve $V_R$ is diverted out the outlet $O_2$ through the recirculating pump $P_R$ and back into the inlet header of the heat exchanger 10 so that the inlet temperature of the feedwater including the recirculated portion is raised. The remainder of the feedwater that does not need to be recirculated passes out of the outlet $O_1$ to the feedwater connection FC on the boiler B. This serves to regulate the flow of the feedwater in such a way that the average outlet temperature of the flue gases from the heat exchanger 10 will be maintained above a prescribed value to prevent condensation of the corrosive chemical compounds in the flue gases on the heat exchange tubes 65 in the tube bundle 12 and the attendant corrosion thereof. The dew point of the flue gases from the boiler B is determined primarily by the sulfur content of the fuel being burned therein, and the sulfur content in the fuel varies between the different geographical sources of the fuel. Usually, the user knows the critical dew point of the flue gases from information provided by the source of the fuel and can then adjust the controller $C_{SP}$ each time the sulfur content in the fuel varies to make sure that the average outlet flue gas temperature is above its dew point after passage through the heat exchanger 10.

Figure 5:
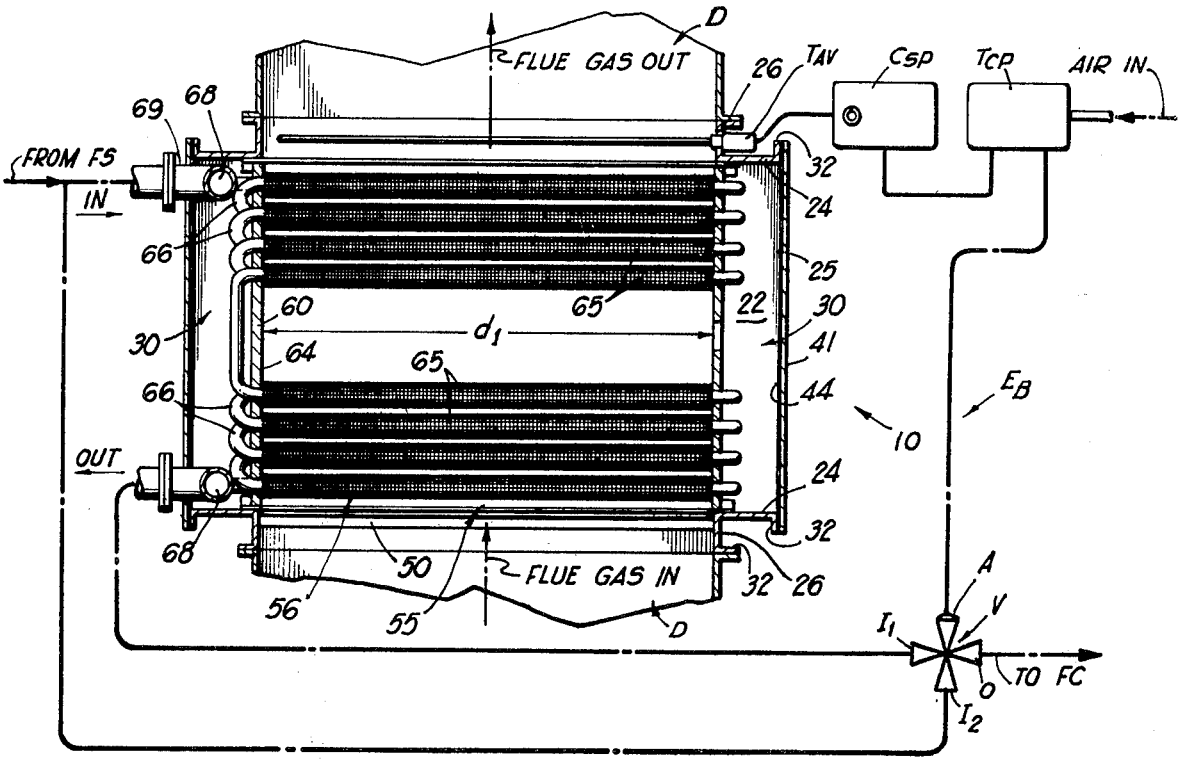

The heat exchanger 10 is shown incorporated in a bypass economizer $E_B$ in FIG. 5. The economizer $E_B$ would be mounted in the flue gas ductwork D on a conventional steam boiler B similarly to economizer $E_R$. The feedwater under pressure from the feedwater source FS is supplied directly to the inlet header 68 on heat exchanger 10. The outlet header 68 on heat exchanger 10 is connected to one inlet $I_1$ on a three-way diversion valve $V_B$ whose outlet O is connected to the feedwater connection FC on boiler B. The other inlet $I_2$ on valve $V_B$ is connected to the feedwater source FS in parallel with the tube bundle 56 in heat exchanger 10. The valve $V_B$ serves to selectively divide the flow of the feedwater from source FS between the flowing through the tube bundle 56 and that bypassing the tube bundle 56. The valve $V_B$ has an actuator A similar to that of the valve $V_R$.

The economizer $E_B$ also uses an averaging thermocouple $T_{AV}$, a set point controller $C_{SP}$ and a transducer $T_{CP}$ to control the actuator A on valve $V_B$. Thus, it will be seen that the controller $C_{SP}$ can be adjusted so that the feedwater flowing through the tube bundle 56 and bypassing the tube bundle 56 can be proportioned by the valve $V_B$ in response to the outlet temperature of the flue gases after passage about the tube bundle 56 to maintain the flue within a prescribed temperature range. As the load on the boiler B varies, the temperature of the flue gases passing through the ductwork D also varies, however, the output from the thermocouple $T_{AV}$ controls the three-way valve $V_B$ in such a way that the feedwater flow is controlled to maintain the flue gas temperature after passing through the tube bundle 56 in heat exchanger 10 at a prescribed value to prevent condensation of the corrosive chemical compounds in the flue gases on the heat exchange tubes 65 and the attendant corrosion thereof.

We claim:

1. A heat exchanger for placing a main fluid in a heat exchange relationship with a heat exchange fluid comprising:

a housing defining a main fluid passage along a common passage axis therethrough through which the main fluid flows and a tube bundle access opening to said main fluid passage, said housing including a pair of spaced apart, generally parallel side walls, each of said side walls comprising a generally rectilinear main central section and a pair of generally rectilinear end tube subchamber extensions integral with opposite ends of said main central section and centered on the longitudinal axis of said central section so that said end tube subchamber extensions on opposed side walls are opposed to each other and said main central sections on opposed side walls are opposed to each other, each of said end tube subchamber extensions defining upper and lower ends and a projecting extension edge thereon, each of said main central sections projecting above and below said end tube subchamber extensions and defining upper and lower projecting central edges thereon;

a pair of subchamber cross plates connecting the respective upper and lower ends of each set of said end tube subchamber extensions opposed to each other to define an end tube subchamber, said end tube subchamber extensions and said subchamber cross plates defining a pair of said tube bundle access openings on opposite sides of said housing at the projecting extension edges of said end tube subchamber extensions;

a pair of fluid passage cross plates connecting the respective upper and lower projecting edges of said main central sections of said side walls laterally aligned with each other to define said main fluid passage with said end tube subchambers opening into said main fluid passage on opposite sides thereof and with said end tube subchambers centered on a common access axis generally normal to and intersecting said common fluid passage axis; and a pair of spaced apart, generally parallel slide rails extending between said subchamber cross plates on opposite ends of said housing connecting the lower edges of said end tube subchamber extensions, one of said slide rails carried by each of said main central sections of said side walls;

a tube bundle unit removably received in said housing through said tube bundle access opening and supported by said housing in said main fluid passage, said tube bundle unit including a tube bundle frame comprising a pair of spaced aprt, generally parallel tube sheets oriented generally normal to a longitudinal tube bundle axis and a plurality of side rails connecting said tube sheets, said side rails oriented generally parallel to the tube bundle axis so that when said tube bundle frame is slidably positioned in said housing with said slide rails on said housing carrying said side rails on said tube bundle unit, said tube sheets are in alignment with said fluid passage cross plates to separate said end tube subchambers from said main fluid passage; and a tube bundle carried by said tube sheets, said tube bundle including a plurality of generally straight heat exchange tubes extending between said tube sheets within said tube bundle frame, a plurality of tube ends serially connecting said heat exchange tubes outboard of said tube sheets, an inlet supply head connected to said heat exchange tubes outboard of said tube sheets, to introduce the heat transfer fluid into said heat exchange tubes, an outlet header connected to said heat exchange tubes outboard of said tube sheets to remove heat transfer fluid from said heat exchange tubes, an outlet supply pipe to said inlet header, and an outlet supply pipe to said outlet header; and cover means for selectively closing said tube bundle access opening to prevent the flow of the main fluid out of said main fluid passage so that said tube bundle unit places the heat exchange fluid therein in a heat exchange relationship with the main fluid in said main fluid passage, said cover means including a pair of cover panels removably attached to said subchamber cross plate and said end tube subchamber extensions to selectively close said tube bundle access openings, said cover panels defining pipe openings therethrough in registration with inlet and outlet supply pipes on said headers through which said supply pipes extend to externally introduce heat transfer fluid in and remove heat transfer fluid from said headers.

2. The heat exchanger of claim 1 for use as an economizer on a steam boiler having a feedwater inlet, a feedwater source, and an exhaust duct through which heated flue gases are discharged wherein said housing is connected to the boiler exhaust duct so that the heated flue gases are the main fluid and pass through said tube bundle unit in a heat exchange relationship therewith and wherein the heat exchange fluid is the feedwater from the feedwater source, the combination with said heat exchanger of:

flow control means for directing feedwater to the feedwater inlet of said boiler through said tube bundle unit to heat the feedwater and cool the flue gases, said flow control means responsive to the temperature of the flue gases after passage around said tube bundle unit to selectively recirculate a prescribed portion of the feedwater after passage through said tube bundle unit back through said tube bundle unit to maintain the temperature of the flue gases after passage around said tube bundle within a prescribed temperature range above the dew point of the flue gases.

3. The heat exchanger of claim 1 for use as an economizer on a steam boiler having a feedwater inlet, a feedwater source, and an exhaust duct through which heated flue gases are discharged wherein said housing is connected to the boiler exhaust duct so that the heated flue gases are the main fluid and pass through said tube bundle unit in a heat exchange relationship therewith and wherein the heat exchange fluid is the feedwater from the feedwater source, the combination with said heat exchanger of:

flow control means for selectively directing feedwater to the feedwater inlet of said boiler through said tube bundle unit to heat the feedwater and cool the flue gases and directly to the feedwater inlet bypassing said tube bundle unit, said flow control means responsive to the temperature of the flue gases after passage around said tube bundle unit to maintain the temperature of the flue gases after passage around said tube bundle unit within a prescribed temperature range above the dew point of the flue gases.

4. The economizer unit of claim 2 wherein said flow control means further includes:

recirculating pump means;

flow control valve means operatively connecting said heat exchange tube bundle, said recirculating pump means, and the boiler feedwater inlet to the feedwater source so that feedwater from the feedwater source can be selectively directed to the boiler feedwater inlet through said tube bundle and so that feedwater can be recirculated back through said tube bundle by said recirculating pump means after passage through said tube bundle and before entering the boiler feedwater inlet;

temperature sensing means for sensing the temperature of the flue gases after passage around said tube bundle; and control circuit means operatively connecting said flow control valve means and said temperature sensing means to cause said flow control valve means to selectively recirculate portions of the feedwater flowing from said tube bundle back through said tube bundle before entering the boiler feedwater inlet so as to maintain the flue gases in said prescribed temperature range after passage around said tube bundle.

5. A heat exchanger construction for attachment to duct sections carrying a main fluid to be placed in a heat exchange relationship with a heat exchange fluid comprising:

a housing adapted to be connected between the duct sections carrying the main fluid to form a continuous duct passage so that the main fluid flows from one of the duct sections to another of the duct sections through said housing, said housing including a pair of spaced apart, generally parallel, side walls generally in alignment with opposite sides of the duct sections and extending between the duct sections, each of said side walls having a first pair of generally opposed side edges and a second pair of generally opposed end edges, said side walls connected to the duct sections along said first pair of side edges;

a pair of end tube cross plate assemblies connecting said side walls along said opposed end edges and extending between the duct sections so as to define a main fluid passage about a main passage axis through said housing extending between the duct sections corresponding in cross-sectional size to that of the duct sections and so as to define a pair of end tube subchambers on opposite sides of said main passage and coaxially aligned about an access axis generally normal to said main passage axis, each of said end tube subchambers opening into said main fluid passage on opposite sides thereof, at least one of said end tube cross-plate assemblies defining an access opening thereto in opposition to the opening between said end tube subchamber associated with said end tube cross plate assembly and said main fluid passage, having a cross-sectional size and shape corresponding to the opening between said end tube subchamber and said main passage, and coaxially located about the access axis; and a pair of spaced apart slide rails mounted on said side walls and extending along opposite sides of said main fluid passage between the openings between said end tube subchambers and said main fluid passage;

a tube bundle unit removably received in said housing through said tube access opening and supported by said housing in said main fluid passage, said tube bundle unit including a tube bundle frame comprising a pair of spaced apart, generally parallel tube sheets oriented generally normal to a longitudinal tube bundle axis and a plurality of side rails connecting said tube sheets, said side rails oriented generally parallel to the tube bundle axis so that when said tube bundle frame is slidably positioned in said housing with said slide rails on said housing carrying said side rails on said tube bundle unit, said tube sheets are in alignment with said fluid passage cross plates to separate said end tube subchambers from said main fluid passage; and a tube bundle carried by said tube sheets, said tube bundle including a plurality of heat exchange tubes extending between said tube sheets within said tube bundle frame, a plurality of tube ends serially connecting said heat exchange tubes outboard of said tube sheets, an inlet supply head connected to said heat exchange tubes outboard of said tube sheets, to introduce the heat transfer fluid into said heat exchange tubes, an outlet header connected to said heat exchange tubes outboard of said tube sheets to remove heat transfer fluid from said heat exchange tubes, an outlet supply pipe to said inlet header, and an outlet supply pipe to said outlet header; and cover means for selectively closing said tube bundle access opening to prevent the flow of the main fluid out of said main fluid passage so that said tube bundle unit places the heat exchange fluid therein in a heat exchange relationship with the main fluid in said main fluid passage, said cover means including a cover panel removably attached to said cross plate assembly defining said access opening therethrough to selectively close said access opening, said cover panel defining pipe openings therethrough in registration with inlet and outlet supply pipes on said headers through which said supply pipes extend to externally introduce heat transfer fluid in and remove heat transfer fluid from said headers so that said cover panel may be replaced while said tube bundle unit is removed for repair so that the main fluid can continue to flow through said housing while said tube bundle unit is removed without loss of the main fluid.

6. The heat exchanger construction of claim 5 wherein said tube bundle frame includes sealing means about said tube sheets for selectively sealing said end tube subchambers from said main fluid passage when said tube bundle unit is in place in said housing.

7. A heat exchanger construction for attachment between spaced apart duct sections adapted to carry gaseous medium to be placed in a heat exchange relationship with a heat exchange fluid comprising:

a housing adapted to be connected between the spaced apart duct sections and defining a main gas passage therethrough about a gas passage axis in registration with the duct sections with the gaseous medium flowing from one duct section to the other through said housing, said housing further defining a pair of end tube subchambers on opposie sides of said main gas passage coaxially located along a common access axis generally normal to the gas passage axis, said end tube subchambers opening into said main gas passage on opposite sides thereof, said housing further defining an access opening to at least one of said end tube subchambers opposite said main gas passage and said housing further including a pair of spaced apart slide rails mounted said housing along opposite sides of said main gas passage between said end tube subchambers;

a tube bundle unit removably received in said housing through said access opening and extending across said main gas passage between said end tube subchambers, said tube bundle unit including a tube frame and a tube bundle carried by said tube frame, said tube frame including a pair of spaced apart tube sheets and a plurality of side members connecting said tube sheets and slidably engaging said slide rails on said housing to support said tube bundle unit so that said tube sheets are in registration with the openings between said main gas passage and said end tube subchambers and substantially filling the openings when said tube bundle unit is in place in said housing to separate said main gas passage from said end tube subchambers; and said tube bundle including heat exchange tubes between said tube sheets, fluid headers located outboard of said tube sheets and connected to said heat exchange tubes, and fluid pipes to said headers for introducing to and removing from said tube bundle unit the heat exchange fluid, said fluid pipes projecting through said access opening in said housing when said tube bundle unit is in place in said housing; and a cover member separate from said tube bundle unit removably closing said access opening, said cover panel defining a plurality of pipe openings therethrough in registration with said fluid pipes when said cover panel is closing said access opening with said fluid pipes projecting through said pipe openings in sealing engagement therewith so that said cover member may be used to reclose said access opening while said tube bundle unit is removed or repair so that the gaseous medium can continue to flow through said housing while said tube bundle unit is removed without loss of the gaseous medium.

* * * * *